US006835756B2

(12) United States Patent
Font Freide et al.

(10) Patent No.: US 6,835,756 B2
(45) Date of Patent: Dec. 28, 2004

(54) FISCHER-TROPSCH SYNTHESIS PROCESS

(75) Inventors: Josephus Johannes Helena Maria Font Freide, Guildford (GB); Stephen Fortune, Sugar Land, TX (US); Barry Nay, Woking (GB); David Newton, Farnham (GB)

(73) Assignees: BP Exploration Operating Company Ltd., London (GB); Davy Process Technology Limited, London (GB)

( * ) Notice: Subject to any disclaimer, the term of this patent is extended or adjusted under 35 U.S.C. 154(b) by 0 days.

(21) Appl. No.: 10/398,769

(22) PCT Filed: Oct. 9, 2001

(86) PCT No.: PCT/GB01/04487

§ 371 (c)(1),
(2), (4) Date: Jun. 17, 2003

(87) PCT Pub. No.: WO02/31083

PCT Pub. Date: Apr. 18, 2002

(65) Prior Publication Data

US 2004/0044090 A1 Mar. 4, 2004

Related U.S. Application Data

(60) Provisional application No. 60/239,889, filed on Oct. 13, 2000.

(51) Int. Cl.[7] ..... C07C 27/00

(52) U.S. Cl. ..... 518/712; 518/700; 518/710

(58) Field of Search ..... 518/700, 712, 518/710

(56) References Cited

U.S. PATENT DOCUMENTS 5,252,613 A 10/1993 Chang et al.
5,409,960 A * 4/1995 Stark ..... 518/700
5,900,159 A 5/1999 Engel et al.

FOREIGN PATENT DOCUMENTS

DE 32 31 813 A1 3/1984
WO WO 01/94499 A1 12/2001

* cited by examiner

*Primary Examiner*—J. Parsa
(74) *Attorney, Agent, or Firm*—Nixon & Vanderhye

(57) ABSTRACT

Process for the conversion of synthesis gas to liquid hydrocarbon products by contacting, in a slurry reactor, synthesis gas at an elevated temperature and pressure with a suspension of catalyst in a liquid medium, introducing a low boiling solvent into the slurry reactor, vaporising at least a portion of the low boiling solvent in the slurry reactor, withdrawing from the slurry reactor, a gaseous stream comprising unreacted synthesis gas and vaporised low boiling solvent, cooling at least a portion of the gaseous stream to a temperature at which liquid condenses out so as to form a two phase mixture of gas and condensed liquid, and recycling at least a portion of the gas and at least a portion of the condensed liquid to the slurry reactor.

21 Claims, 2 Drawing Sheets

FISCHER-TROPSCH SYNTHESIS PROCESS

This application is the U.S. national phase of international application PCT/GB01/04487, filed 9 Oct. 2001, which designated the U.S. and which claims benefit of U.S. Provisional Application No. 60/239,889 filed Oct. 13, 2000.

The present invention relates to a process for the conversion of carbon monoxide and hydrogen (synthesis gas) to liquid hydrocarbon products in the presence of a Fischer-Tropsch catalyst.

BACKGROUND OF THE INVENTION

In the Fischer-Tropsch reaction a gaseous mixture of carbon monoxide and hydrogen is reacted in the presence of a heterogeneous catalyst to give a hydrocarbon mixture having a relatively broad molecular weight distribution. This product is predominantly straight chain, saturated hydrocarbons which typically have a chain length of more than 5 carbon atoms. The reaction is highly exothermic and therefore heat removal is one of the primary constraints of all Fischer-Tropsch processes. This has directed commercial processes away from fixed bed operation to slurry systems. Such slurry systems employ a suspension of catalyst particles in a liquid medium thereby allowing both the gross temperature control and the local temperature control (in the vicinity of individual catalyst particles) to be significantly improved compared with fixed bed operation.

Fischer-Tropsch processes which employ particulate fluidised beds in slurry bubble column reactors are described in, for example, U.S. Pat. Nos. 5,348,982; 5,157,054; 5,252,613; 5,866,621; 5,811,468; and 5,382,748. Slurry bubble column reactors operate by suspending catalytic particles in a liquid and feeding gas phase reactants into the bottom of the reactor through a gas distributor which produces small gas bubbles. As the gas bubbles rise through the reactor, the reactants are absorbed into the liquid and diffuse to the catalyst where, depending on the catalytic system, they can be converted to both liquid and gaseous products. If gaseous products are formed, they enter the gas bubbles and are collected at the top of the reactor. Liquid products are recovered by passing the slurry through a filter which separates the liquid from the catalytic solids. A principal advantage of slurry reactors over fixed bed reactors is that the pressure of a circulating/agitated slurry phase greatly increases the transfer rate of heat to cooling surfaces built into the reactor. A distinct advantage of bubble columns over mechanically stirred reactors is that the required mixing is effected by the action of rising bubbles, a process significantly more efficient in energy than mechanical stirring.

U.S. Pat. No. 5,252,613 described a method and means for improving catalyst particle distribution and mixing in slurry bubble column, the catalyst being primarily distributed and suspended in the slurry by the energy imparted from the synthesis gas rising from the gas distribution means at the bottom of the slurry bubble column, said improved catalyst distribution and mixing being obtained by introducing a secondary stream of gas into the slurry bubble column by use of a secondary gas introduction means located within the column at a location above the gas distribution means at the bottom of the slurry bubble column. The secondary gas stream may comprise a portion of the reactive feed gas or recycle gas or it may be separately added inert gas, or condensed light hydrocarbons or process end products which vaporize under the conditions present at the location of introduction.

SUMMARY OF THE INVENTION

It has now been found that at least a portion of the heat of reaction can be efficiently removed from a slurry by vaporising a low boiling solvent in a slurry reactor, withdrawing a gaseous stream comprising unconverted synthesis gas and vaporised low boiling solvent from the slurry reactor, cooling the gaseous stream to a temperature sufficient to form a two phase mixture of gas and condensed liquid and recycling the condensed liquid and gas either separately or together to the slurry reactor. Evaporation of the low boiling solvent in the slurry reactor and cooling of the gaseous recycle stream results in the removal of at least a portion of the heat of reaction. Evaporation of the low boiling solvent in the slurry reactor also assists in maintaining the catalyst particles suspended in the slurry.

Accordingly, the present invention relates to a process for the conversion of synthesis gas to liquid hydrocarbon products comprising:

a) contacting, in a slurry reactor, synthesis gas at an elevated temperature and pressure with a suspension of catalyst in a liquid medium,
b) introducing a low boiling solvent into the slurry reactor
c) vaporising at least a portion of the low boiling solvent in the slurry reactor,
d) withdrawing from the slurry reactor, a gaseous stream comprising unreacted synthesis gas and vaporised low boiling solvent,
e) cooling at least a portion of the gaseous stream to a temperature at which liquid condenses out so as to form a two phase mixture of gas and condensed liquid, and
f) recycling at least a portion of the gas and at least a portion of the condensed liquid to the slurry reactor.

The process of the present invention is advantageous in that it can reduce or eliminate altogether the need for removal of heat of reaction from the slurry reactor by heat exchange of the slurry with a heat transfer material which may, for example, be circulating on the shell side of a shell and tube reactor when the Fischer Tropsch reaction takes place in the tubes, or through the tubes when the reaction takes place on the shell side. Without wishing to be bound by any theory, it is believed that vaporisation of the low boiling solvent in the slurry reactor and cooling of at least a portion of the withdrawn gaseous stream to below a temperature at which liquid condenses out, removes at least some of the exothermic heat of reaction thereby allowing more control over the product selectivities and minimising the production of gaseous by-products, for example, methane.

The slurry reactor may be any reactor suitable for carrying out highly exothermic, three phase, catalytic reactions. Suitably, the slurry reactor is a "slurry bubble column" as described in, for example, U.S. Pat. Nos. 5,348,982; 5,157,054; 5,252,613; 5,866,621; 5,811,468; and 5,382,748 which are herein incorporated by reference.

Suitably, the ratio of hydrogen to carbon monoxide in the synthesis gas is in the range of from 20:1 to 0.1:1, especially 5:1 to 1:1 by volume, typically 2:1 by volume. The synthesis gas may contain additional components such as nitrogen, water, carbon dioxide and lower hydrocarbons such as unconverted methane.

Preferably, the liquid hydrocarbon products comprise a mixture of hydrocarbons having chain lengths of greater than 5 carbon atoms. Suitably, the liquid hydrocarbon products comprise a mixture of hydrocarbons having chain lengths of from 5 to about 90 carbon atoms, preferably a major amount, for example, greater than 60% by weight, of the hydrocarbons have chain lengths of from 5 to 30 carbon atoms. For avoidance of doubt by "liquid hydrocarbon products" is meant hydrocarbons which are liquid under the process conditions.

Low boiling solvent is defined herein as a solvent having a boiling point, at standard pressure, in the range of from 30 to 280° C., preferably from 30 to 210° C. Preferably, the low boiling solvent is selected from the group consisting of aliphatic hydrocarbons having from 5 to 10 carbon atoms, alcohols (preferably, alcohols having from 1 to 4 carbon atoms, in particular, methanol), and water. In order to simplify the process, it is preferred that the low boiling solvent is a low boiling liquid hydrocarbon product or mixtures thereof, such as hydrocarbon products having from 5 to 10 carbon atoms, in particular, pentanes, hexanes, or hexenes.

The liquid medium may comprise a low boiling solvent and/or a high boiling solvent. By high boiling solvent is meant a solvent having a boiling point, at standard pressure of greater than 280° C. In order to simplify product recovery, it is preferred that the high boiling solvent is a high boiling liquid hydrocarbon product.

For practical reasons the slurry reactor is generally not totally filled with suspension during the process of the present invention so that above a certain level of suspension a gas cap is present in the top of the slurry reactor. Preferably, the volume of the gas cap is not more than 40%, preferably not more than 30% of the volume of the slurry reactor. Suitably, the gaseous stream is withdrawn from the gas cap.

The gaseous stream which is withdrawn from the slurry reactor (hereinafter "withdrawn gaseous stream") may comprise gaseous hydrocarbon products, vaporised low boiling liquid hydrocarbon products, and vaporised water by-product in addition to unconverted synthesis gas and vaporised low boiling solvent.

Suitably, a heat exchanger or exchangers may be used to cool the withdrawn gaseous stream. Suitable heat exchangers are well known in the art. Preferably, substantially the whole of the withdrawn gaseous stream is cooled by means of the heat exchanger(s).

In a first embodiment of the process of the present invention, at least part of the two phase mixture of gas and condensed liquid is passed to a gas-liquid separator wherein the condensed liquid phase is separated from the gas phase to give a liquid stream and a gaseous stream. At least part of the liquid stream is recycled either directly or indirectly to the slurry reactor (hereinafter "liquid recycle stream"). It is preferred that substantially the whole of the withdrawn gaseous stream is cooled and passed to the gas-liquid separator. Preferably, substantially all of the liquid stream from the gas-liquid separator is recycled either directly or indirectly to the slurry reactor. Preferably, excess water (a by-product of the process of the present invention) is removed from the liquid recycle stream using, for example, a decanter, before recycling the liquid to the slurry reactor so as to prevent the build up of water in the slurry reactor. Fresh low boiling solvent may be introduced into the liquid recycle stream.

Suitable means for separating the condensed liquid from the two phase mixture of gas and condensed liquid are, for example, cyclone separators, knock-out drums, demister type gas-liquid separators and liquid scrubbers, for example, venturi scrubbers. Such gas-liquid separators are well known in the art.

The gaseous stream from the gas-liquid separator (hereinafter "gaseous recycle stream") may be recycled to the slurry reactor. Suitably, the gaseous recycle stream may be recycled to the slurry reactor through a primary gas distribution means located at the bottom of the slurry reactor. Suitably, the primary gas distribution means may comprise bubble caps, spargers or multicone arrays (as described in U.S. Pat. No. 5,252,613). It may be necessary to compress the gaseous recycle stream before it is recycled to the slurry reactor (as will be evident to the person skilled in the art).

Preferably, a purge stream is taken from the gaseous recycle stream to prevent accumulation of gaseous by-products, for example, methane, in the slurry reactor.

Sufficient make-up synthesis gas may be introduced with the gaseous recycle stream to replace the synthesis gas which is converted to gaseous and liquid hydrocarbon products in the slurry reactor. The make-up synthesis gas may be introduced into the withdrawn gaseous stream upstream of the heat exchanger(s). Alternatively, the make-up synthesis gas may be introduced downstream of the heat exchanger(s), for example, into the gaseous recycle stream. Where the make-up synthesis gas has not been pre-cooled, it is preferred that the make-up synthesis gas is introduced into the withdrawn gaseous stream upstream of the heat exchanger(s). It is also envisaged that make-up synthesis gas may be separately introduced into the slurry reactor.

The liquid recycle stream may be introduced directly into the slurry reactor through at least one secondary fluid distribution means located below the level of suspension in the slurry reactor and above the primary gas distribution means. It is preferred that the secondary fluid distribution means is sited in the lower part of the slurry reactor, more preferably within the lower 20% of the vertical height of the slurry in the slurry reactor but above the primary gas distribution means. A plurality of secondary fluid distributions means may be located at either substantially the same or different vertical heights of the slurry in the slurry reactor.

Preferably, the secondary fluid distribution means is a suitably arranged injection means. The liquid recycle stream may be passed from the gas-liquid separator to such injection means using, for example, a suitable pump. A single injection means may be used or a plurality of injection means may be arranged within the slurry in the slurry reactor. A preferred arrangement is to provide a plurality of injection means substantially equally spaced in the slurry reactor in the region of introduction of the liquid recycle stream. A preferred number of injection means is 3 to 5, for example, 4. Each of the injection means may, if desired, be supplied with the liquid recycle stream by means of a common conduit suitably arranged within the slurry reactor.

The preferred injection means is a nozzle or a plurality of nozzles which include gas-induced atomising nozzles in which a gas (for example, fresh synthesis gas or gaseous recycle stream from the gas-liquid separator) is used to assist in the injection of the liquid, or liquid-only spray-type nozzles. Preferred gas-induced atomising nozzles are as described in WO 96/20780 and WO 97/18888 and preferred liquid-only spray-type nozzles are as described in WO 98/18548 which are herein incorporated by reference.

The liquid recycle stream may be introduced indirectly into the slurry reactor together with a hydrocarbon reduced slurry stream which is recycled to the slurry reactor from the liquid hydrocarbon recovery stage (see below).

The liquid recycle stream may be subjected to additional cooling (e.g. using refrigeration techniques) before being introduced directly or indirectly into the slurry reactor. This allows an even greater cooling effect in the slurry reactor than is provided by the liquid evaporative effect (latent heat of evaporation) alone. Cooling of the liquid recycle stream may be achieved by use of a suitable cooling means e.g. a simple heat exchanger or refrigerator located between the separator and the slurry reactor.

In a second embodiment of the present invention, at least a portion of the withdrawn gaseous stream may be cooled to form a two phase mixture of gas and entrained condensed liquid which two phase mixture is recycled to the slurry reactor (hereinafter referred to as operation in the "condensing mode").

It is important that the gas to liquid ratio be maintained at a level sufficient to keep the liquid phase of the two phase mixture in an entrained or suspended condition until the mixture enters the slurry reactor. Preferably, the quantity of liquid in the gas phase is less than 75 weight percent, more preferably less than 50 weight percent, most preferably less than 25 weight percent provided always that the velocity of the two phase mixture is high enough to keep the liquid phase in suspension in the gas phase. Suitably, the velocity of the two phase mixture is at least 1 $ms^{-1}$, preferably, at least 5 $ms^{-1}$.

Preferably, substantially the whole of the withdrawn gaseous stream is cooled to form a two phase mixture of gas and entrained condensed liquid and substantially the whole of this two phase mixture is recycled to the slurry reactor.

Suitably, a heat exchanger or exchangers may be used to cool the withdrawn gaseous stream to below a temperature at which a two phase mixture of gas and entrained condensed liquid is formed.

Make-up synthesis gas may be introduced into the two phase mixture of gas and entrained condensed liquid at any suitable location either upstream or downstream of the heat exchanger(s). Alternatively, make-up synthesis gas may be separately introduced to the slurry reactor.

Fresh low boiling solvent may be introduced into the two phase mixture provided that the gas to liquid ratio and the velocity of the two phase mixture are sufficient to ensure that the fresh low boiling solvent becomes entrained in the gas phase. The fresh low boiling solvent may be introduced into the two phase mixture using a gas-induced atomising nozzle or a liquid-only spray-type nozzle.

The two phase mixture of gas and entrained condensed liquid may be recycled to the slurry reactor through a primary gas distribution means located at the bottom of the slurry reactor and optionally through a secondary fluid distribution means located below the level of suspension in the slurry reactor and above the primary gas distribution means. Suitable primary gas distribution means are as described above for the first embodiment of the process of the present invention. Suitable secondary fluid distribution means include spargers.

The process of the present invention may also be operated using a combination of the first and second embodiments of the present invention wherein a first portion of a two phase mixture of gas and entrained condensed liquid is recycled directly to the slurry reactor and a second portion of the two phase mixture is passed to a gas-liquid separator to form a gaseous stream and a liquid stream which are separately recycled to the slurry reactor.

It is envisaged that in each of the embodiments of the present invention, a portion of the heat of reaction may be removed by a heat transfer fluid which is either circulating on the shell side of a shell and tube reactor when the reaction takes place in the tube, or through the tubes when the reaction takes place on the shell side (as described in U.S. Pat. No. 5,252,613).

Preferably, for each of the embodiments of the present invention, a suspension comprising catalyst suspended in the liquid reaction medium and liquid hydrocarbon products is withdrawn from the slurry reactor at any suitable location above the primary gas distribution means. Where a secondary fluid distribution means is present in the slurry reactor, the suspension is preferably withdrawn at a location above the secondary fluid distribution means.

The withdrawn suspension may then be separated into a light fraction comprising at least a portion of the lighter components of the withdrawn suspension (typically comprising gaseous hydrocarbon products, vaporised low boiling solvent, vaporised low boiling liquid hydrocarbon products and vaporised water by-product) and a heavy fraction (typically comprising liquid hydrocarbon products, any high boiling solvent and catalyst particles).

Suitably, the light fraction is cooled, for example, by means of at least one heat exchanger, to assist in removal of the exothermic heat of reaction. Where the light fraction is cooled to below its dew point, liquid will condense out of the vapour fraction to form a two phase mixture. This two phase mixture may be recycled to the slurry reactor ("condensing mode" of operation). Alternatively, the condensed liquid may be separated from any residual gases using a suitable gas-liquid separator (such as those described above). The separated condensed liquid may then be recycled either directly or indirectly to the slurry reactor or may be removed from the system. In order to prevent the accumulation of water by-product in the slurry reactor, it is preferred to remove any excess water (water by-product) from the separated condensed liquid, for example, using a decanter, before recycling the separated condensed liquid to the slurry reactor (via a suitable pump). Suitably, in the second embodiment of the process of the present invention, the condensed liquid which is separated from the light fraction may be recycled to the slurry reactor together with the condensed liquids which are separated from the withdrawn gaseous stream. The residual gases from the light fraction may be recycled to the slurry reactor (via a suitable compressor) or may be removed from the system.

Suitably, the light and heavy fractions are separated in a flash distillation zone which is maintained at a pressure substantially below that of the slurry reactor.

The flash distillation zone may be operated without the addition of heat (adiabatic conditions) or with the addition of heat. Preferably, the flash distillation zone is operated under adiabatic conditions.

Generally, it is preferred that the flash distillation zone is maintained at a pressure of at least 5 bar lower than the pressure in the slurry reactor. Preferably, the pressure in the flash distillation zone is maintained at a pressure of at least 7 bar lower, preferably at a pressure of at least 10 bar lower than the pressure in the slurry reactor. The flash distillation zone may be maintained at very low pressures, even approaching a complete vacuum. However, it is usually desirable that the flash distillation zone be maintained at a positive pressure to eliminate vapour compression equipment and the like in handling the vapour stream withdrawn from the flash distillation zone.

The exact pressure of the flash distillation zone may vary, depending on the temperature and pressure maintained in the slurry reactor, it is important that the pressure differential between the flash distillation zone and the slurry reactor be sufficient to ensure vaporisation of a substantial portion of the low boiling solvent, any water and any low boiling liquid hydrocarbon products in the flash distillation zone. In practice this means that the total pressure in the flash distillation zone should be less than the vapour pressure of the liquid medium and liquid hydrocarbon products in the suspension withdrawn from the slurry reactor at the temperature of said liquid components and preferably at least 5 bar less. For example, if at the temperature and pressure of the slurry reactor, the low boiling solvent, any water and any low boiling hydrocarbon products to be vaporised have a vapour pressure of 25 bar, the flash distillation zone should preferably be operated at a pressure of less than 20 bar. Preferably the flash distillation zone of the present invention will be operated at a pressure of from 1 to 30 bar. Most preferably the flash distillation zone will be operated at a pressure of 1 to 20 bar.

Where the process is operated in a continuous manner the flash distillation zone is preferably large enough to allow the suspension that is passed to it from the slurry reactor to be maintained in the flash distillation zone for a sufficient period of time to be degassed. Usually a residence time of at least one minute in the flash distillation zone is sufficient.

It is envisaged that a series of flash distillation zones may be employed with a staged step down in pressure at each successive flash distillation zone. Preferably, the process of the present invention employs 1 to 3 flash distillation zones.

Suitably, the heavy fraction is separated to give a liquid hydrocarbon product stream and a hydrocarbon reduced slurry. The separation may be achieved, for example, using a hydrocyclone, a filter, a gravity separator, a magnetic separator or by distillation. The hydrocarbon reduced slurry is then recycled to the slurry reactor. Fresh catalyst may be added either to the hydrocarbon reduced slurry or directly into the slurry reactor. It is also envisaged that fresh low boiling solvent may be added to the recycled hydrocarbon reduced slurry. Also, as described above, the liquid recycle stream of the first embodiment of the present invention may be recycled indirectly to the slurry reactor together with the hydrocarbon reduced slurry.

The liquid product stream, which has been separated from the catalyst, is then passed to a purification stage. Typically, the liquid product stream comprises high boiling liquid hydrocarbon products, high boiling solvent, unvaporised water (introduced as low boiling solvent or arising as a by-product of the Fischer-Tropsch synthesis reaction), unvaporised low boiling solvent, and unvaporised low boiling liquid hydrocarbon products. In the purification stage, water may be removed from the liquid product stream, for example, using a decanter. Preferably, the remaining liquids are then passed to a product purification zone, for example, a fractional distillation zone.

The catalyst which may be employed in the process of the present invention is any catalyst known to be active in Fischer-Tropsch synthesis. For example, Group VIII metals whether supported or unsupported are known Fischer-Tropsch catalysts. Of these iron, cobalt and ruthenium are preferred, particularly iron and cobalt, most particularly cobalt.

A preferred catalyst is supported on an inorganic oxide, preferably a refractory inorganic oxide. Preferred supports include silica, alumina, silica-alumina, the Group IVB oxides, titania (primarily in the rutile form) and most preferably zinc oxide. The support generally has a surface area of less than about 100 $m^2/g$ but may have a surface area of less than 50 $m^2/g$ or less than 25 $m^2/g$, for example, about 5 $m^2/g$.

The catalytic metal is present in catalytically active amounts usually about 1–100 wt %, the upper limit being attained in the case of unsupported metal catalysts, preferably 2–40 wt %. Promoters may be added to the catalyst and are well known in the Fischer-Tropsch catalyst art. Promoters can include ruthenium, platinum or palladium (when not the primary catalyst metal), aluminium, rhenium, hafnium, cerium, lanthanum and zirconium, and are usually present in amounts less than the primary catalytic metal (except for ruthenium which may be present in coequal amounts), but the promoter:metal ratio should be at least 1:10. Preferred promoters are rhenium and hafnium.

The catalyst may have a particle size in the range 5 to 5000 microns, preferably 5 to 3000 microns, more preferably 5 to 1700 microns, most preferably 5 to 500 microns, and advantageously 5 to 100 microns, for example, in the range 5 to 30 microns.

Preferably, the suspension of catalyst in the slurry reactor comprises 5 to 50% wt of catalyst particles, for example 10 to 30% wt of catalyst particles.

The present invention can be operated in batch or continuous mode, the latter is preferred.

The process of the invention is preferably carried out in the slurry reactor at a temperature of 180–360° C., more preferably 190–240° C.

The process of the invention is preferably carried out in the slurry reactor at a pressure of 5–50 bar, more preferably 15–35 bar, generally 20–30 bar.

BRIEF DESCRIPTION OF THE DRAWINGS

The invention will now be illustrated with the aid of FIGS. 1 and 2 which represent schematic diagrams of two embodiments of the process of the present invention.

DETAILED DESCRIPTION OF THE INVENTION

Figure 1:
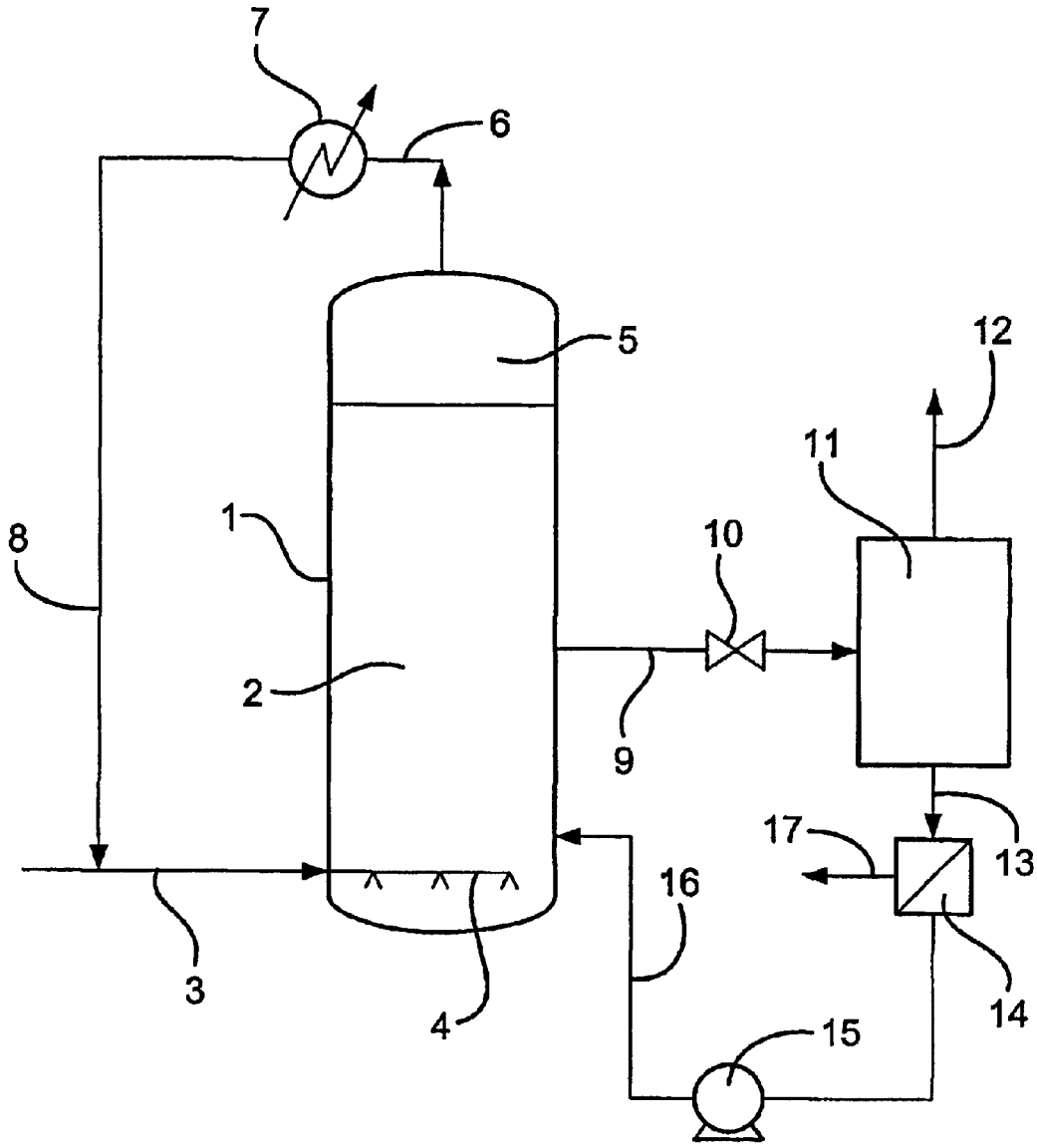

FIG. 1 illustrates a "condensing mode" of operation of the process of the present invention. Slurry reactor (1) is at least partially filled with a suspension (2) of catalyst in a liquid medium and also contains a vaporisable low boiling solvent. The slurry reactor (1) is maintained at a temperature of from 180 to 360° C. and at a pressure of from 5 to 50 bar. Synthesis gas is introduced into the slurry reactor (1) via line (3) and primary gas distribution means (4). A gaseous recycle stream comprising unconverted synthesis gas, gaseous hydrocarbon products, vaporised low boiling solvent, vaporised low boiling hydrocarbon products and vaporised water by-product is withdrawn from a gas cap (5) which is present in the upper part of the slurry reactor (1) via line (6). By means of a heat exchanger (7) the withdrawn gaseous stream passing through the line (6) is cooled to below its dew point to form a two phase mixture of gas and entrained liquid. The entrained liquid typically comprises low boiling solvent, low boiling hydrocarbon products and water by-product. The two phase mixture of gas and entrained liquid is recycled to the slurry reactor (1) via lines (8) and (3). It is also envisaged that at least a portion of the two phase mixture of gas and entrained liquid may be recycled to the slurry reactor via a secondary fluid introduction means (not shown) located above the primary gas distribution means (4). Fresh low boiling solvent may be introduced into the line (8) provided that the gas to liquid ratio and the velocity of the two phase mixture are sufficient to ensure that the fresh low boiling solvent becomes entrained in the gaseous phase (not shown).

Suspension is withdrawn from the slurry reactor (1) through line (9). Pressure let-down valve (10) is disposed in line (9) to let the pressure down at least 5 bar as it enters flash distillation zone (11) where the suspension is degassed. A light fraction comprising gaseous hydrocarbon products, unconverted synthesis gas, any vaporised low boiling solvent, any vaporised low boiling liquid hydrocarbon products and any vaporised water may be withdrawn from the flash distillation zone (11) through line (12). The light fraction may be cooled to a temperature at which liquid condenses out from the residual gas and the condensed liquid may be recycled to the slurry reactor (1) either entrained in the gas or separately from the gas (not shown).

The heavy fraction may be withdrawn from the flash distillation zone (11) through line (13). By a suitable liquid-solid separation means (14) (e.g. a hydrocyclone, a filter, a gravity or magnetic separator, or by distillation) the liquid component of the heavy fraction is separated from the catalyst to give a liquid product stream and a hydrocarbon reduced slurry. The hydrocarbon reduced slurry may be returned to the slurry reactor (1) via a slurry pump (15) and a line (16).

The liquid product stream from the separation means (14) is then passed via line (17) to a purification zone (not shown).

Figure 2:
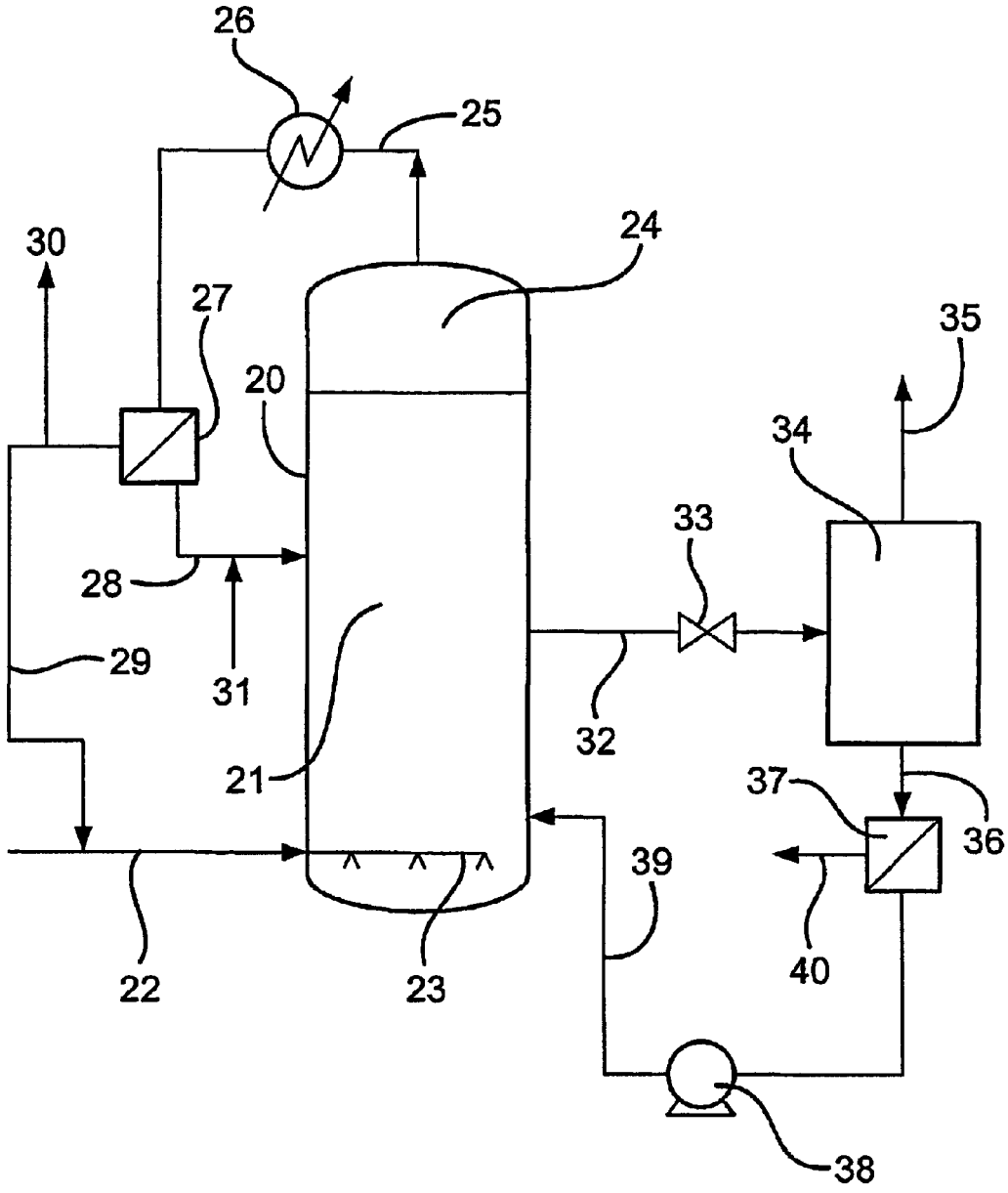

FIG. 2 illustrates an alternative mode of operation of the process of the present invention in which condensed liquid is separated from the gaseous recycle stream. Slurry reactor (20) is at least partially filled with a suspension (21) of catalyst in a liquid medium. A low boiling solvent is also present in the slurry reactor (20). Synthesis gas is introduced into the slurry reactor (20) through line (22) and a primary gas distribution means (23). The slurry reactor (20) is maintained at a temperature of from 180 to 360° C. and at a pressure of from 5 to 50 bar. A gaseous stream comprising unconverted synthesis gas, gaseous hydrocarbon products, vaporised low boiling solvent, vaporised low boiling hydrocarbon products and vaporised water by-product is withdrawn from a gas cap (24) which is present in the upper part of the slurry reactor (20) via line (25). By means of a heat exchanger (26) the withdrawn gaseous stream passing through the line (25) is cooled to below its dew point to form a two phase mixture of gas and condensed liquid The condensed liquid typically comprises low boiling solvent, low boiling hydrocarbon products and water. The two phase mixture is then passed to a gas-liquid separator (27) where the condensed liquid phase is separated from the gaseous phase to form a liquid stream and a gaseous stream. The liquid stream from the gas-liquid separator is then recycled directly to the slurry reactor (20) via line (28) (after removing any excess water using, for example, a decanter, not shown). The liquid stream may be introduced into the slurry reactor (20) via a secondary fluid introduction means, for example, one or more nozzles (not shown). The gaseous stream from the gas-liquid separator (27) is introduced into the slurry reactor (20) via lines (29) and (22) and the primary gas distribution means (23). A purge stream (30) may be taken from line (29) to prevent the build up of gaseous by-products in the gas cap (24). Fresh low boiling solvent may be introduced into line (28) via line (31).

Suspension is withdrawn from the slurry reactor (20) through line (32). Pressure let-down valve (33) is disposed in line (32) to let the pressure down at least 5 bar as it enters flash distillation zone (34) where the suspension is separated into a light fraction and a heavy fraction. The light fraction comprising gaseous hydrocarbon products, unconverted synthesis gas, any vaporised low boiling solvent, any vaporised low boiling liquid hydrocarbon products and any vaporised water may be withdrawn from the flash distillation zone (34) through line (35). The light fraction may be cooled to a temperature at which liquid condenses out from the residual gas and the condensed liquid may be recycled to the slurry reactor (20) either entrained in the gas or separately from the gas (not shown).

The heavy fraction may be withdrawn from the flash distillation zone (34) through line (36). By a suitable separation means (37) (e.g. a hydrocyclone, a filter, a gravity or magnetic separator, or by distillation) the liquid component of the heavy fraction is then separated from the catalyst to give a liquid product stream and a hydrocarbon reduced slurry. The hydrocarbon reduced slurry of catalyst may be returned to the slurry reactor (20) via a slurry pump (38) and a line (39).

The liquid product stream from the separation means (36) is then passed via a line (40) to a purification zone (not shown).

What is claimed is:

1. A process for the conversion of synthesis gas to liquid hydrocarbon products comprising:

a) contacting, in a slurry reactor, synthesis gas at an elevated temperature and pressure with a suspension of catalyst in a liquid medium, b) introducing a low boiling solvent into the slurry reactor, c) vaporising at least a portion of the low boiling solvent in the slurry reactor, d) withdrawing from the slurry reactor, a gaseous stream comprising unreacted synthesis gas and vaporised low boiling solvent, e) cooling at least a portion of the gaseous stream to a temperature at which liquid condenses out so as to form a two phase mixture of gas and condensed liquid, and f) recycling at least a portion of the gas and at least a portion of the condensed liquid to the slurry reactor.

2. A process as claimed in claim 1 wherein the low boiling solvent is selected from the group consisting of aliphatic hydrocarbons having from 5 to 10 carbon atoms, alcohols having from 1 to 4 carbon atoms, and water.

3. A process as claimed in claim 2 wherein the low boiling solvent is selected from pentanes, hexanes, hexenes and water.

4. A process as claimed in claim 1 wherein a gas cap is present in the top of the slurry reactor and the gaseous stream is withdrawn from the gas cap.

5. A process as claimed in claim 4 wherein the volume of the gas cap is not more than 40% of the volume of the slurry reactor.

6. A process as claimed in claim 1 wherein the gaseous stream withdrawn from the slurry reactor additionally comprises gaseous hydrocarbon products, vaporised low boiling liquid hydrocarbon products and vaporised water by-product.

7. A process as claimed in claim 1 wherein at least part of the two phase mixture of gas and condensed liquid is passed to a gas-liquid separator wherein the condensed liquid is separated from the gas and at least part of the separated condensed liquid is recycled either directly or indirectly to the slurry reactor.

8. A process as claimed in claim 7 wherein the gas separated in the gas-liquid separator is at least in part recycled to the slurry reactor through a primary gas distribution means located at the bottom of the slurry reactor.

9. A process as claimed in claim 7 wherein the separated condensed liquid is introduced directly into the slurry reactor through a secondary fluid introduction means located below the level of suspension in the slurry reactor and above the primary gas distribution means.

10. A process as claimed in claim 9 wherein the secondary fluid introduction means comprises at least one nozzle.

11. A process as claimed in claim 1 wherein the gaseous stream withdrawn from the slurry reactor is cooled to form a two phase mixture of gas and entrained condensed liquid which two phase mixture is recycled to the slurry reactor.

12. A process as claimed in claim 11 wherein the quantity of entrained liquid in the two phase mixture is less than 75 weight percent.

13. A process as claimed in claim 12 wherein at least part of the two phase mixture of gas and entrained liquid is recycled to the slurry reactor through a primary gas distribution means located at the bottom of the slurry reactor.

14. A process as claimed in claim 13 wherein part of said two phase mixture of gas and entrained liquid is recycled to the slurry reactor through a secondary fluid introduction means located below the level of suspension in the slurry reactor and above the primary gas distribution means.

15. A process as claimed in claim 1 wherein a suspension comprising catalyst suspended in liquid hydrocarbon products is withdrawn from the slurry reactor.

16. A process as claimed in claim 15 wherein the withdrawn suspension is separated into (i) a light fraction comprising gaseous hydrocarbon products, vaporised low boiling solvent, vaporised low boiling liquid hydrocarbon products and vaporised water by-product and (ii) a heavier fraction comprising unvaporised liquid hydrocarbon products and catalyst.

17. A process as claimed in claim 16 wherein the light fraction is cooled to form a two phase mixture of gas and entrained condensed liquid.

18. A process as claimed in claim 17 wherein the two phase mixture of gas and entrained condensed liquid is recycled to the slurry reactor.

19. A process as claimed in claim 17 wherein the two phase mixture is passed to a gas-liquid separator wherein the condensed liquid is separated from the gas and the separated condensed liquid is recycled to the slurry reactor.

20. A process as claimed in claim 16 wherein the light fraction is separated from the heavy fraction in at least one flash distillation zone.

21. A process as claimed in claim 16 wherein the heavy fraction is passed to a liquid-solid separation stage wherein the liquid hydrocarbon products are separated from a hydrocarbon reduced slurry and the hydrocarbon reduced slurry is recycled to the slurry reactor.

* * * * *